US011116366B2

(12) United States Patent
Milliron

(10) Patent No.: US 11,116,366 B2
(45) Date of Patent: Sep. 14, 2021

(54) TOILET SEAT SECURING DEVICE

(76) Inventor: Jimmie Milliron, Bremerton, WA (US)

( * ) Notice: Subject to any disclaimer, the term of this patent is extended or adjusted under 35 U.S.C. 154(b) by 359 days.

(21) Appl. No.: 13/184,805

(22) Filed: Jul. 18, 2011

(65) Prior Publication Data

US 2013/0019389 A1 Jan. 24, 2013

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/237, 234, 239
See application file for complete search history.

(56) References Cited

U.S. PATENT DOCUMENTS

| | | | | |
|---|---|---|---|---|
| 3,646,620 | A * | 3/1972 | McCawley | 4/237 |
| 4,747,167 | A * | 5/1988 | Adams | 4/234 |
| 5,212,840 | A * | 5/1993 | Caldwell | 4/237 |
| 8,091,152 | B1 * | 1/2012 | Rucker et al. | 4/234 |

* cited by examiner

*Primary Examiner* — Christine J Skubinna
(74) *Attorney, Agent, or Firm* — Houda El-Jarrah; Bold IP, PLLC

(57) ABSTRACT

A toilet seat securing device comprising: an elongated body, where the elongated body curves beneath a lateral portion of an underside of a toilet seat and where the elongated body is available as a pair, a single elongated body beneath each lateral portion of the toilet seat; a lip extending perpendicularly from a periphery of the elongated body, where the lip extends in an opposite direction from the toilet seat and where the lip is wider than the toilet seat to fit around an outer rim of a toilet bowl when the toilet seat is positioned atop the toilet bowl; and a plurality of fastening means attached to the elongated body, where the plurality of fastening means secure the toilet seat securing device to the underside of the toilet seat.

8 Claims, 2 Drawing Sheets

TOILET SEAT SECURING DEVICE

BACKGROUND OF THE INVENTION

Field of the Invention

The present invention relates to a device that attaches beneath a toilet seat to ensure that the toilet seat does not wobble or shift beneath a user.

Description of Related Art

Standard toilet seat rests upon a toilet bowl attached with a hinge at the back of the toilet seat by the tank. Commonly, with repeated use the hinge may loosen causing the toilet seat to wobble and shift. After continuous shifting, the hinge may break or the toilet seat may even crack requiring replacement of the seat. Over time the need to replace toilet seats may become inconvenient, difficult and even expensive especially if the seat has to be changed more than once a year.

Recently, devices have been developed to assist a user to prevent their toilet seats from shifting and wobbling. For example, U.S. Pat. No. 5,091,999 by Anthony L. Turner, Jr. discloses a commode seat organization wherein a toilet seat includes peg-like members positioned beneath the seat. The peg-like members are received by a set of grooves recessed into the rim of the toilet bowl. However, the fastening members not only modify the toilet seat they also modify the bowl requiring a customized toilet rather than the standard toilets found in most households. U.S. Pat. No. 5,361,425 by Frank Armanno, Sr. discloses lateral retainers for toilet seat wherein a set of retainers are attached beneath a toilet seat. The retainers include angular protrusions which extend down on each side of the toilet bowl rim to hold the seat in place. Unfortunately, the retainers are held in place at a single point with adhesive or screws which may not uphold the repeated toilet seat use.

It would be desirable in the art to provide a toilet seat securing unit that may be attached to a common toilet seat. It would also be beneficial in the art to provide a toilet seat securing unit that attaches at more than a single point for greater stability against the toilet seat.

SUMMARY OF THE INVENTION

In view of the foregoing disadvantages inherent in the prior art, the general purpose of the present invention is to provide a toilet seat securing device, configured to include all of the advantages of the prior art, and to overcome the drawbacks inherent therein.

Accordingly, an object of the present invention is to provide a toilet seat securing device that easily attaches beneath a standard toilet seat or alternatively an elongated toilet seat.

Another object of the present invention is to provide a toilet seat securing device including a lip that rests outside a rim of a toilet bowl, following the curve of the toilet bowl for an elongated fit beneath the seat.

To achieve the above objects, in an aspect of the present invention, a toilet seat securing device is described comprising: an elongated body, where the elongated body curves beneath an underside of a toilet seat; a lip extending perpendicularly from a periphery of the elongated body, where the lip extends in an opposite direction from the toilet seat and where the lip is wider than the toilet seat to fit around an outer rim of a toilet bowl when the toilet seat is positioned atop the toilet bowl; and a plurality of fastening means attached to the elongated body, where the plurality of fastening means secure the toilet seat securing device to the underside of the toilet seat.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DRAWINGS

The present invention relates to a device that attaches beneath a toilet seat to ensure that the toilet seat does not wobble or shift beneath a user. The present invention provides a toilet seat securing device to securely fit a toilet seat above a toilet bowl when in a lowered position. The toilet seat securing device is an elongated member with a perpendicular lip attached to a peripheral edge of the elongated member, wherein the lip prevents the seat from shifting upon the bowl during use. The toilet seat securing device is attached beneath the toilet seat with multiple fasteners which may be a variety of items including screws, bolts, Velcro pieces or adhesive pieces. As such, the beneficial combination of an elongated body member, the lip and the fasteners embodied in the toilet seat securing device creates an object which provides greater stability for the toilet seat thereby preventing wobbling, shifting and breakage during repeated use.

Figure 1:
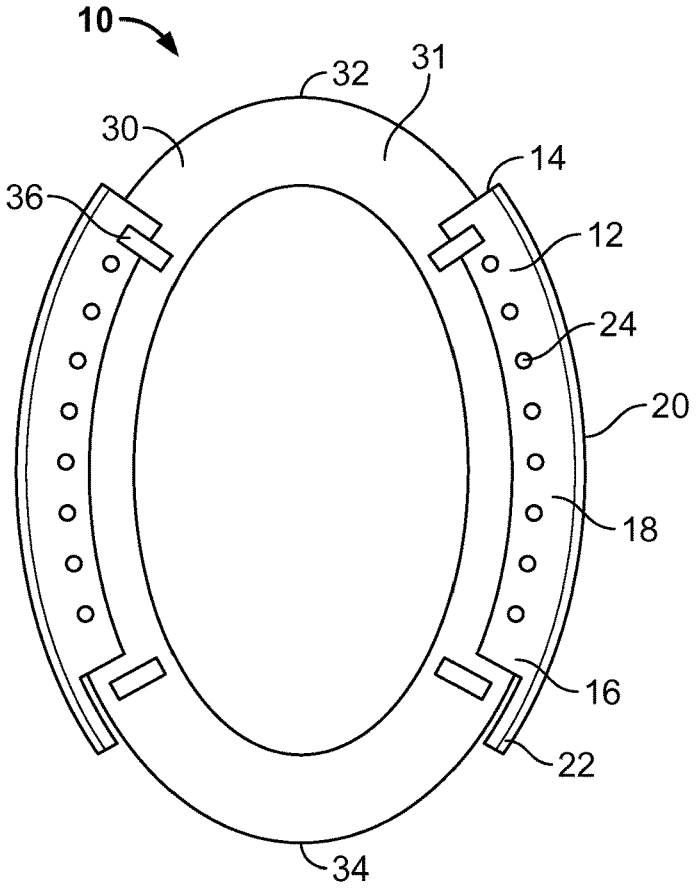
FIG. 1 depicts a bottom view of a toilet seat securing device attached to a toilet seat in accordance with an exemplary embodiment of the present invention.

Turning now descriptively to the drawings, referring to FIG. 1, a bottom view of a toilet seat securing device (10) attached to a toilet seat (30) is shown in accordance with an exemplary embodiment of the present invention. FIG. 1 illustrates an underside (31) of the toilet seat (30) and a bottom surface (18) of the toilet seat securing device (10). The toilet seat securing device (10) may include a pair of elongated bodies (12) (hereinafter elongated body wherein all of the elements described are included on each elongated body) attached one on each lateral portion of the toilet seat (30). The elongated body (12) extends from a front end (14), towards a front (32) of the toilet seat (30), to a back end (16), towards a back of the toilet seat (34). The elongated body (12) may curve to follow the outer curve of the toilet seat (30), and may be sized to fit the common dimensions for a standard or elongated toilet seat. The elongated body (12)

may be made from a plastic, aluminum, wood, metal alloy or similar materials commonly known and used with toilets. The elongated body (12) may be positioned between a set of toilet seat spacers (36) or it may be formed around the spacers (36) (as shown).

Figure 2:
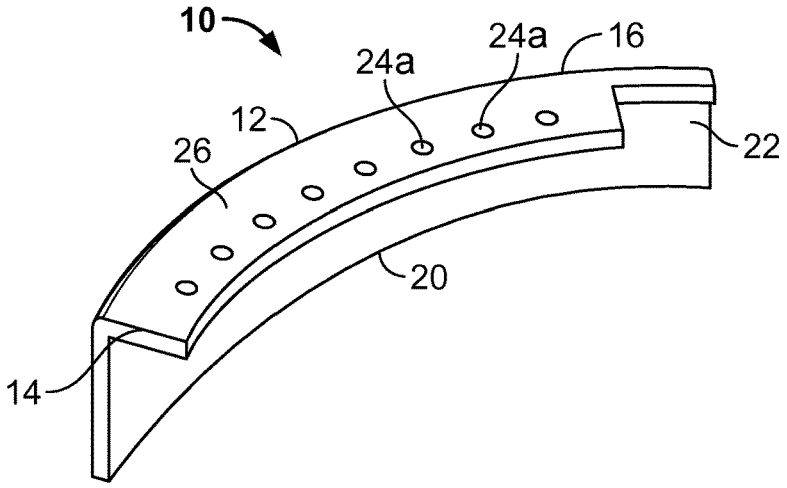
FIG. 2 depicts a perspective view of a toilet seat securing device in accordance with an exemplary embodiment of the present invention.
Figure 3:
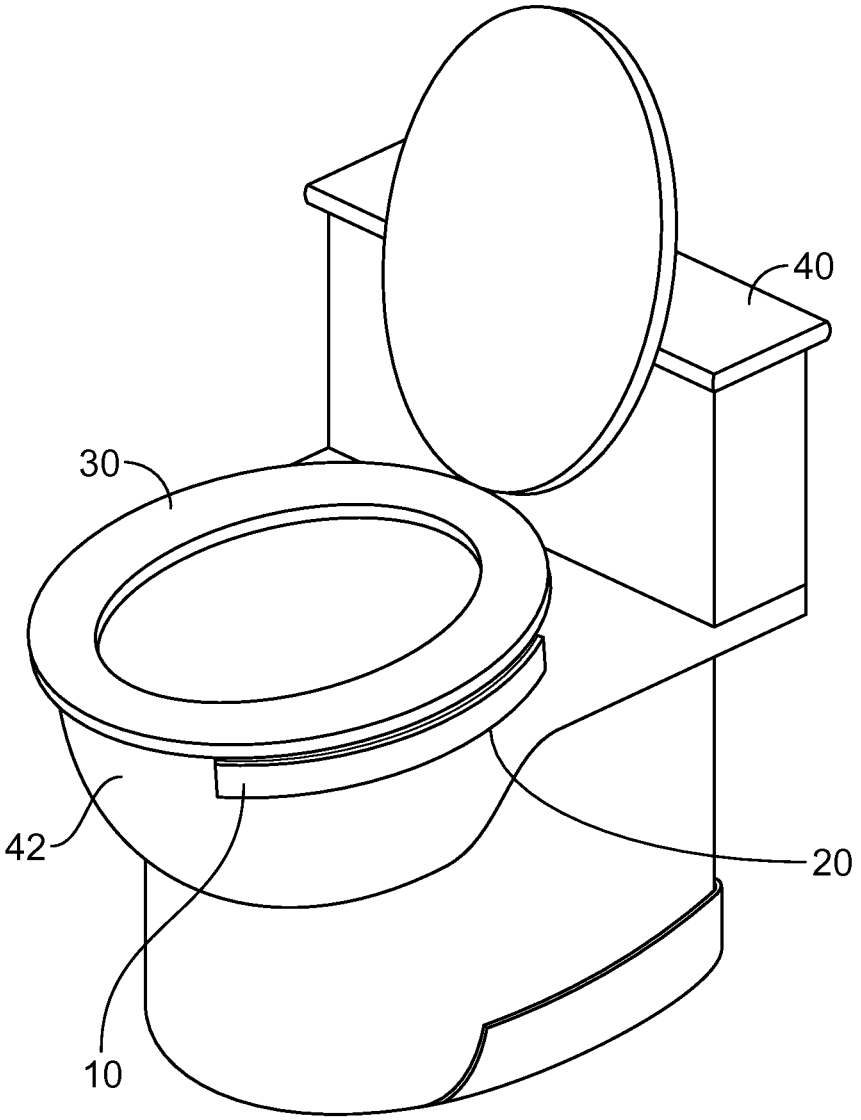
FIG. 3 depicts a perspective view of a toilet seat securing device attached to a toilet in accordance with an exemplary embodiment of the present invention.

Around a periphery of the elongated body (12) is a lip (20). The lip (20) extends perpendicularly from the outer edge of the elongate body (12) (as better illustrated in FIG. 2), away from the toilet seat (30). Additionally, the lip (20) is sized just wider than the outer edge of the toilet seat (30), so that when the toilet seat (30) is positioned on a toilet bowl the lip (20) wraps partially around the outer edge of the toilet bowl (as illustrated in FIG. 3). At the back end (16) of the lip (20) may be a lip extension (22). The lip extension (22) may be a protrusion that adds length to the lip (20) beyond the length of the elongated body (12) therefore providing greater stability of the toilet seat securing device (10) around the toilet bowl.

The toilet seat securing device (10) may be attached to the underside (31) of the toilet seat (30) with a plurality of fastening means (24) (hereinafter fastening means). The fastening means (24) may be screws, bolts, pegs or the like wherein the fastening means (24) punctures through a plurality of openings (24*a*) in the toilet seat securing device (10) as shown in FIG. 2 and into the underside (31) of the toilet seat (30) as shown in FIG. 1. The fastening means (24) are long enough to fit through the elongated body (12) and substantially into the toilet seat (30), but not too long to where they puncture through the toilet seat (30).

Referring to FIG. 2 a perspective view of the toilet seat securing device (10) is shown in accordance with an exemplary embodiment of the present invention. FIG. 2 illustrates a top surface (26) of the elongated body (12), and more distinctly illustrates how the lip (20) extends perpendicularly from the elongated body (12). The top surface (26) rests adjacent to the underside (31) of the toilet seat (30) during use. An alternative option for the fastening means (24*a*) is shown, wherein the fastening means are attached to the top surface (26) and are positioned between the top surface (26) of the elongated body (12) and the underside (31) of the toilet seat (30). The fastening means (24*a*) may be a heavy duty adhesive fasteners or a hook and loop fastener (commonly known as Velcro®).

The dimension of the toilet seat securing device (10) may be: the length of the elongated body (12) ranges from of 3-15 inches, preferably 10 inches; the width of the elongated body (12) ranges between 1-3 inches, preferably 1.5 inches; the depth of the lip (20) ranges from 1-4 inches, preferably 1.5 inches; and the length of the lip extension (22) ranges from 1-5 inches, preferably 2 inches.

Referring to FIG. 3 a perspective view of the toilet seat securing device (10) positioned on a toilet (40) is shown in accordance with an exemplary embodiment of the present invention. The toilet seat securing device (10) is fastened beneath the toilet seat (30), with the lip (20) extending down against the outer rim of the toilet bowl (42). The lip (20) may rest close against the toilet bowl (42) to prevent shifting of the toilet seat (30). Yet the lip (20) must not be too tight against the toilet bowl (42) which would prevent the user from lifting and lowering the toilet seat (30) as desired. The toilet seat securing device (10) may prevent the toilet seat (30) from shifting and wobbling which in turn prevents toilet seat (30) from scuffing, loosening or cracking.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A toilet seat securing device comprising:

an attachable elongated body, where the attachable elongated body curves beneath a lateral portion of an underside of a toilet seat configured to be positioned over a toilet bowl, and where the attachable elongated body is available as a pair of single elongated bodies, wherein each single elongated body of the pair of single elongated bodies is positioned beneath each lateral portion of the toilet seat;

a lip extending perpendicularly from a periphery of each single elongated body of the pair of single elongated bodies, where the lip extends in an opposite direction from the toilet seat and where the lip fits partially around an outer rim of the toilet bowl when the toilet seat is positioned atop the toilet bowl;

a plurality of openings arranged in a row along a length of an underside of each single elongated body of the pair of single elongated bodies; and a plurality of fastening means configured to attach to each single elongated body of the pair of single elongated bodies through the plurality of openings, where the plurality of fastening means secure the toilet seat securing device to the underside of the toilet seat.

2. The toilet seat securing device according to claim 1, wherein the lip includes a lip extension where the lip extension is a length of the lip that protrudes beyond each single elongated body of the pair of single elongated bodies.

3. The toilet seat securing device according to claim 1, wherein the plurality of fastening means puncture through each single elongated body of the pair of single elongated bodies into the underside of the toilet seat.

4. The toilet seat securing device according to claim 1, wherein the plurality of fastening means is one of at least a bolt, a screw, and a peg.

5. The toilet seat securing device according to claim 1, wherein the plurality of fastening means is positioned between a top surface of each single elongated body of the pair of single elongated bodies and the underside of the toilet seat.

6. The toilet seat securing device according to claim 1, wherein the toilet seat securing device is not attached to the toilet bowl.

7. The toilet seat securing device according to claim 1, wherein each single elongated body of the pair of single elongated bodies and the lip are fitted to a standard toilet.

8. The toilet seat securing device according to claim 1, wherein each single elongated body of the pair of single elongated bodies and the lip are fitted to an elongated toilet.

* * * * *